US008327834B1

(12) United States Patent
Judge et al.

(10) Patent No.: US 8,327,834 B1
(45) Date of Patent: Dec. 11, 2012

(54) CAMPFIRE SMOKESTACK AND METHOD

(76) Inventors: Marc A. Judge, Traverse City, MI (US); Joseph J Francis, Traverse City, MI (US); James A. Grant, Traverse City, MI (US)

( * ) Notice: Subject to any disclaimer, the term of this patent is extended or adjusted under 35 U.S.C. 154(b) by 136 days.

(21) Appl. No.: 12/786,508

(22) Filed: May 25, 2010

Related U.S. Application Data

(60) Provisional application No. 61/181,793, filed on May 28, 2009.

(51) Int. Cl.
*F24B 3/00* (2006.01)

(52) U.S. Cl. ..... 126/29; 126/25 R; 126/59

(58) Field of Classification Search ..... 126/29, 126/25 R, 25 B, 59, 59.5, 65, 66, 15 R, 28
See application file for complete search history.

(56) References Cited

U.S. PATENT DOCUMENTS

| | | | |
|---|---|---|---|
| 1,189,568 | A | 7/1916 | Hempy |
| 1,348,427 | A | 8/1920 | Landers |
| 1,934,339 | A | 12/1931 | Winberg |
| 3,112,716 | A | 12/1963 | Knight |
| 3,192,918 | A | 7/1965 | Ridgway |
| 4,311,130 | A | 1/1982 | Noose |
| 5,002,037 | A | 3/1991 | Armstrong et al. |
| 5,074,279 | A | 12/1991 | Sainsbury |
| 5,144,939 | A | 9/1992 | Christopherson |
| 5,357,940 | A | 10/1994 | Kalenian |
| 5,682,872 | A | 11/1997 | Whitted |
| 5,833,353 | A | 11/1998 | Smith |
| 7,383,836 | B2 | 6/2008 | Klemming |

FOREIGN PATENT DOCUMENTS

GB 2074309 * 10/1981

* cited by examiner

*Primary Examiner* — Alfred Basichas
(74) *Attorney, Agent, or Firm* — Northern Michigan Patent Law, PLC

(57) ABSTRACT

A campfire smokestack comprising an elongated metal tube whose lower end is anchored in a fire pit, for example by burying it in the ground, prior to making a fire, or by placing it into an existing fire. The tube has an open upper end, and its sidewall is perforated over some portion of its length with draft openings, at least some of which are at campfire height such that the fire is built against or adjacent these lower draft openings to permit radial drafting of air directly through the fire into the tube. The fire is accordingly built and burned around or against the lower end of the tube, rather than within or underneath the tube. The smokestack may be used with both natural and manmade fire pits.

10 Claims, 5 Drawing Sheets

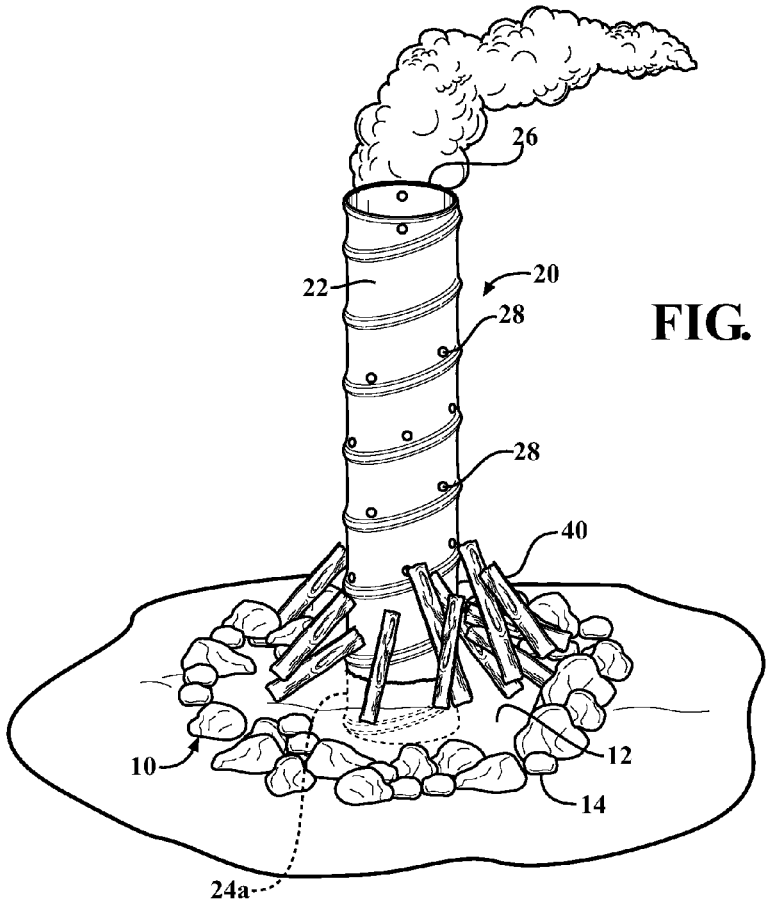
FIG. 1
FIG. 3
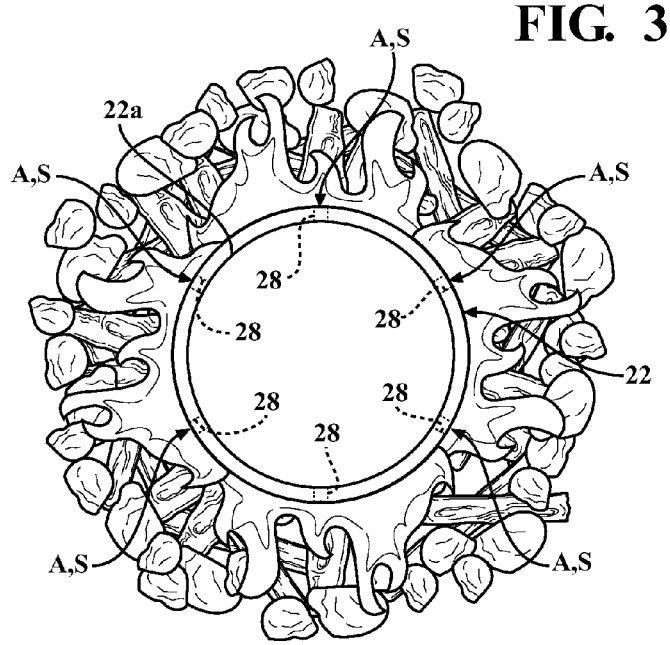

CAMPFIRE SMOKESTACK AND METHOD

RELATED APPLICATIONS/PRIORITY BENEFIT CLAIM

The present application claims the benefit of the priority of U.S. provisional patent application No. 61/181,793 filed May 28, 2009 by the same inventors (Judge, Francis, and Grant), the entirety of which provisional patent application is incorporated by reference.

FIELD OF THE INVENTIVE SUBJECT MATTER

The subject matter of the present application is in the field of tubular draft-inducing devices used with outdoor fires.

BACKGROUND AND DESCRIPTION OF RELATED ART

Campers are familiar with the "smoke in your eyes" phenomenon in which, no matter where they move around the fire, smoke seems to follow them. Campers are also familiar with difficulty in lighting and maintaining a campfire, for example when using substandard wood or in poor weather conditions. Despite these drawbacks, the campfire and its flames are always the center of attention, camaraderie, entertainment and warmth during campouts and other outdoor activities.

Tubular draft-enhancing devices for starting or improving the efficiency of outdoor wood fires and charcoal grills are known. Examples include those shown in U.S. Pat. Nos. 1,189,568 to Hempy (tapered tubular stump burner or "chimney" that surrounds and encloses a stump, with the ground dug away to permit a draft underneath); 1,348,427 to Landers (open-bottomed box stove for use inside a tent over a campfire, with a tapered smokestack); 1,934,339 to Winberg (tapered tubular orchard heater with an above-ground grate to contain a charcoal or similar solid fuel fire); 3,112,716 to Knight (tapered tubular fire starter for outside grills with removable charcoal supporting grate rods to selectively dump ignited charcoal down into the grill); 3,192,918 to Ridgway (removable, coal-enclosing circular flange with a central chimney); 4,311,130 to Noose (fire starter with a circular skirt and tapered central chimney, the skirt overlying the fuel to be ignited); 5,002,037 to Armstrong et al. (portable tapered campfire smokestack with a larger open bottom end supported above and "accommodating" a campfire of reasonable size within its diameter); 5,074,279 to Sainsbury (an open-bottomed and open-topped grill-starter, with a circular band of metal confining the solid fuel); 5,357,940 to Kalenian (grill afterburner in the form of a tubular smokestack addition spaced to one side of the grill to draw the combustion products away from the grill interior); 5,682,872 to Whitted (tubular camping furnace that surrounds the burning fuel and directs smoke upward); and 5,833,353 to Smith (tapered campfire chimney that is itself combustible, with a raised internal updraft chamber for inserting fire starting materials that will ignite a more-rapidly consumed portion of the chimney at a point above the ground, with the flames contained inside the chimney's shell).

With the exceptions of the Armstrong et al and Whitted devices, none of the above appears to be suited for use with open, ground-based campfires of decent size, around which groups of campers like to congregate in the evening.

Armstrong et al's device, although designed for campfires, would obscure a significant portion of the fire underneath and would limit the size of the fire that it accommodates. Whitted's device appears to be intended for efficient cooking with a ground-based wood fire, but not for visually enjoying the flames of an open campfire, as it encloses the fire with a metal wall.

BRIEF SUMMARY OF THE INVENTIVE SUBJECT MATTER

We have invented a portable campfire smokestack useful for starting and maintaining and improving the efficiency, warmth, and fun of a ground-based campfire of any size. "Ground-based" is used herein to mean on or close to the ground, resting upon various non-combustible surfaces or base materials, including but not limited to natural earth, and does not exclude low man-made fire supporting surfaces such as metal or stone bases about which people can sit or stand to enjoy the fire. "Campfire" means any open fire, essentially non-enclosed around its circumference, using wood or wood substitutes (such as artificial logs) as the combustible material, producing open flames for the visual enjoyment and warmth of people standing or sitting adjacent and around the fire.

The smokestack draws the smoke generated by the fire up and away from people seated or standing near the fire (eliminating the smoke-in-your-eyes effect), does not visually obscure the campfire, and enhances the fire's burning. The smokestack does not require any special base, does not require digging out and maintaining draft openings underneath, and does not require combustibles to be inserted inside in order to start or maintain the campfire. The smokestack can be (and preferably is) left in the campfire from start to finish, and can be portable so that it can be relocated to other campfires.

The smokestack is an upright tube with draft openings provided in its sidewall at least partway up its length from the lower end. "Tube" should be construed broadly to include both circular and non-circular (including polygonal) cross-sections with an elongated central passage. The tube is open at its upper end, and is preferably open (but can also be closed) at its bottom end.

The smokestack is employed by anchoring the lower end of the tube to the ground or fire-pit, so that it is stable in an upright position despite wind and the shifting of the fire and the placement of fuel around the tube, and so that the interior of the lower end is essentially sealed relative to the fire except for the draft openings in the lower sidewall. In one method the lower end of the tube is anchored by burying in the fire pit to a point adjacent a campfire "draft level" defined by the lowermost draft openings, and then a campfire is built around (immediately adjacent or against) the exterior of the smokestack and against at least some of the sidewall draft openings associated with the draft level. The upper end of the tube remains above the fire's fuel. The fire is then ignited around the exterior of the anchored tube, with air (and smoke) drafting through the fire into at least some of the lower openings in the sidewall. The tube does not contain the combustible fuel, and the fire's fuel accordingly burns around and against rather than within or underneath the tube. However, once the fire is burning around the base of the tube, combustible items can be dropped into the open upper end and burned for a visual effect that we call "the afterburner" effect.

At a minimum, draft openings are formed in the lower end of the tube at the level of the campfire ("campfire height"). The draft openings can be spaced from one or both ends of the tube, or can run along the entire length of the tube. At least a portion of the draft openings formed in the lower end of the tube define the draft level that lies within the mass of the fire's combustible fuel at campfire height, for example beginning at or adjacent ground level. Some of the draft openings may also be located high enough on the tube to lie above the actual campfire height (the mass of combustible fuel), so that some air (and some smoke) is drawn directly into an upper part of the tube above the fire, and further to provide a visual effect in which the upper openings can be internally illuminated when combustibles are optionally added to the interior of the tube are via the open upper end of the tube. It is also possible to have draft openings only at the lower draft-level end of the tube around which the campfire is built.

"Campfire height" will vary somewhat according to each fire built around the lower, unburied end of the tube adjacent the draft openings, and is primarily defined by the mass of combustible fuel piled or stacked around the exterior sidewall of the tube adjacent the draft openings, but will generally be less than two-thirds, and preferably less than one-half the height of the tube.

The upper end of the tube can optionally be provided with holes or hooks for inserting a stick or tool to lift the hot tube out of the fire pit, even if a fire is still burning (although it is recommended to leave the tube anchored until the fire is out).

These and other features and advantages will become apparent from the detailed description below, in light of the accompanying drawings.

BRIEF DESCRIPTION OF THE DRAWINGS

FIG. 1 is a perspective view of a campfire smokestack according to the invention, with the tube's lower end buried in a fire pit and a campfire built around the lower exposed end of the tube.

FIG. 3 is a top plan view of the campfire smokestack of FIG. 1, as buried in the fire pit.

DETAILED DESCRIPTION OF THE ILLUSTRATED EMBODIMENT

Figure 2:
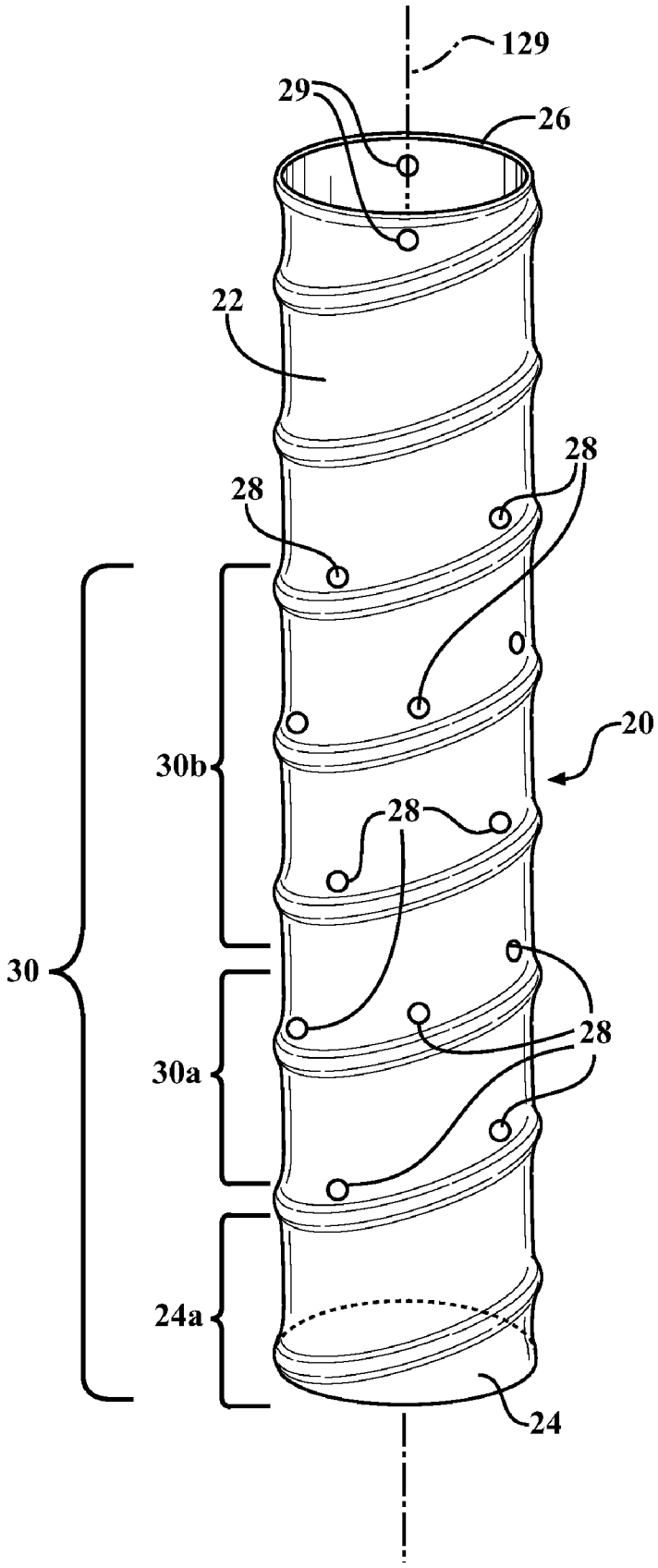
FIG. 2 is a larger, more detailed perspective view of the campfire smokestack of FIG. 1, shown removed from the fire pit.

Referring first to FIGS. 1 through 3, a campfire smokestack 20 is shown in exemplary form in order to teach how to make and use the claimed invention. Smokestack 20 is formed from a tube 22 of metal, in the illustrated example a four- to five-foot length of light-gauge steel stovepipe, for example in the range of three to six inches in diameter, and preferably strong enough to hold its shape when subjected to the heat of a campfire over one or more seasons of use, although one-time use or short-term use versions are possible using thinner or lighter-gauge materials. The length and diameter of the tube can vary, being shorter or longer and/or wider or narrower than the illustrated example, with corresponding affect on the draft. Tube 22 can be a single long tube or multiple tube sections assembled or telescoped together, without limitation as to how the final elongated tube shape is achieved. Tube 22 preferably has a circular cross-section, but can have other cross-sectional shapes including eccentric and polygonal shapes. While a single tube 22 is shown in the illustrated example, it would also be possible to bundle two or more tubes together for a multi-tube smokestack structure. While metal is the preferred material for tube 22, other non-combustible materials could be used. Tube 22 is shown as a cylinder of regular cross-section, but it could also be tapered or have varying cross-section along its length.

Tube 22 is perforated with draft openings 28 along its length between upper end 26 and lower end 24. Draft openings 28 are punched or drilled or otherwise created in the sidewall of the tube, preferably evenly distributed around the circumference of the tube so that air is drawn in fairly evenly around the circumference of the tube, subject to variability in weather conditions and the uniformity or shape of the fire itself. The size and shape of the draft openings can vary, but in the illustrated example the openings are circular and are on the order of ½-1" (inches) in diameter. Draft openings 28 can be placed or formed along substantially the entire length of tube 22, or can be limited to one or more draft regions, designated by bracket 30, over less than the entire length of the tube. In the illustrated example, draft region 30 has a lower "draft level" portion 30*a* adjacent the lower end 24 of the tube, and an optional upper "smoke level" portion 30*b* above 30*a* that may or may not be contiguous with draft level openings 30*a* (e.g, the draft openings in 30*a* and 30*b* could be an unbroken pattern of holes, or they could be separated by an un-perforated region of sidewall 22*a* into two or more distinct groupings of holes). The upper end of the tube is provided with optional "pull" holes 29 radially aligned with one another to receive a stick or poker or tool 129 (FIG. 2) therethrough for the purpose of lifting smokestack 20 when it is hot.

The relative proportions of 30*a* and 30*b* can vary from that shown, and are largely determined by the height of the campfires anticipated to be built around tube 22—the portion of holes 28 radially within the fire (primarily within the mass of combustible/burning fuel, which will vary to some extent over the course of a fire) can be considered 30*a*, and the portion of holes 28 (if any) located above the fire can be considered 30*b*. Draft level holes 30*a* at the level of the campfire are necessary for the desired drafting function, while smoke level (above-the-campfire) holes 30*b* are optional. Accordingly, at a minimum, tube 22 has a grouping of draft openings 28 formed in the lower end of the tube, at or near the lowermost portion of the tube which lies above the ground when the tube is anchored in the fire pit, at the campfire height around which a campfire is to be built.

FIG. 1 shows smokestack 20 anchored in the middle of a typical campfire pit 10, in the form of a ground-level base 12 of dirt, ash, gravel, sand, or combinations thereof, optionally bordered at 14 with a ring of stones or a metal flange or some other low border that helps contain the ashes and embers without significantly obstructing the open fire relative to people gathered around it for warmth and enjoyment. Those skilled in the art of campfires will recognize that fire "pits" can take different forms, and can be made from different materials, can include manmade metal "fire pits" with mesh or screen ember guards around the sides through which the fire can still be seen and its warmth felt like a campfire (FIG. 7), can be raised a short distance from the actual ground or located below ground level, and while normally outdoors could be partially or fully protected by a structure such as a shelter, sauna building, or cabin with an appropriate suspended chimney or other smoke venting arrangement. The example of FIG. 1 shows the lower end 24 of tube 22 (specifically an un-perforated region 24*a* designated for this purpose) buried in the dirt/ash base 12 of fire pit 10, up to a point adjacent the lowermost draft openings 28 that define the beginning of draft level 30*a*.

Other options for anchoring the bottom end of tube 22 in the fire pit include but are not limited to the use of radial feet or legs extending out from the sides of the tube; stabilizing stakes extending from the tube or driven into the ground adjacent the lower end 24; or weighting the lower end 24, for example with concrete or a heavy metal insert, so that the upright tube 22 resists being tipped over. The lower end 24 of tube 22 is shown open in the example in the drawings, since portion 24*a* (best shown in FIG. 2) is intended to be buried and thus sealed below the fire. For other anchoring arrangements where the lower end 24 of the tube is not buried, but rests on the ground, it might be preferred to close the lower end 24, for example with a cap or plate of metal, in which case the draft openings 28 would preferably begin at the lowermost end of the tube's sidewall, rather than above it as shown at 30*a* in FIG. 2.

Figure 4:
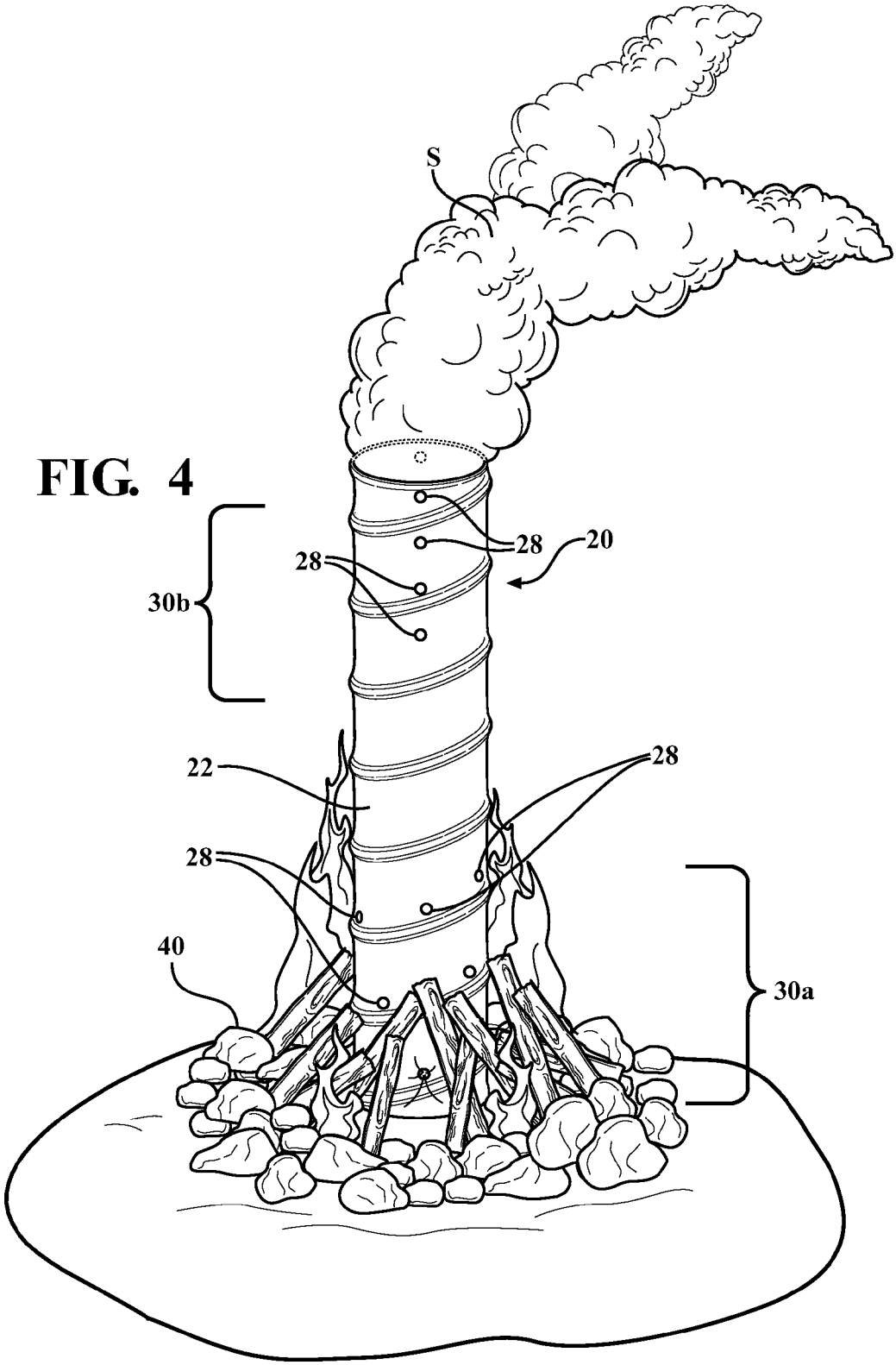
FIG. 4 is a perspective view of the campfire smokestack of FIG. 1 with a campfire built around its lower end, with an alternate draft opening arrangement, and showing the smoke being exhausted from the open upper end.
Figure 5:
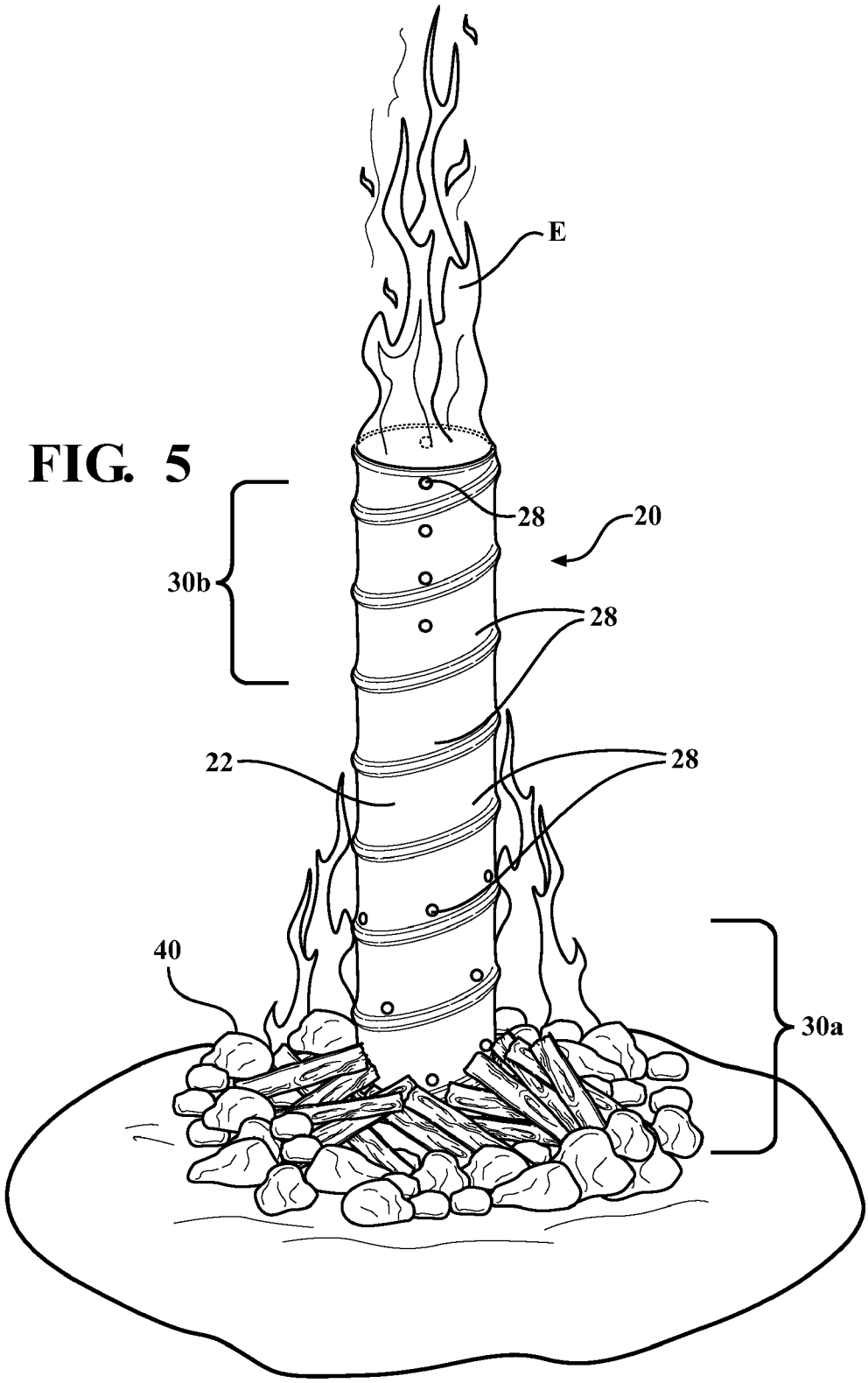
FIG. 5 is a perspective view of the campfire smokestack of FIG. 4, illustrating a visual effect resulting from adding combustibles to the interior of the tube via the open upper end once the campfire is burning.
Figure 6:
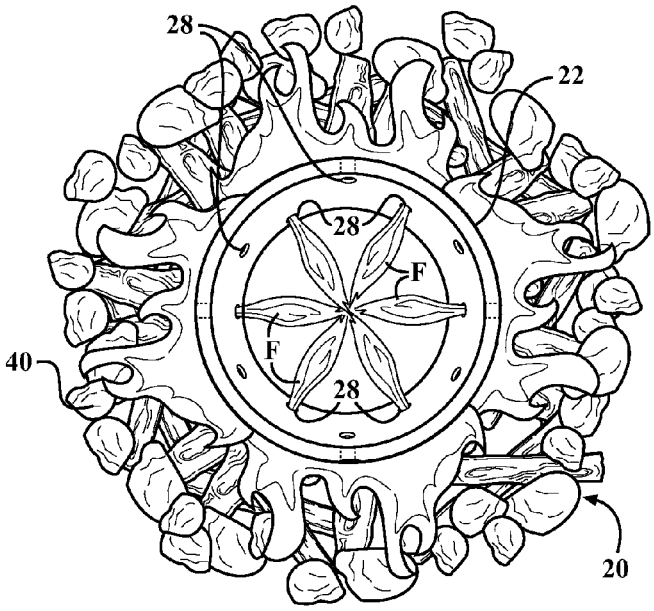
FIG. 6 is a top plan view of the campfire smokestack of FIG. 4, similar to the view of FIG. 3 but with a campfire kindled around the bottom end of the tube and illustrating flame and smoke from the exterior fire being drawn into the tube via the lower draft level openings.

Once smokestack 20 is anchored in the fire pit, a campfire 40 (or rather a pile of combustible material 40 that will fuel the fire) is built or arranged around the lower, above-ground end of tube 22, in particular around the lower draft level region 30*a* of holes 28. The fuel is then lit to ignite the fire, and the tube 22 in the center of the fire begins to draw air A and smoke S radially through holes 28 (FIG. 3) and then up and out the tube's upper end 26 to be exhausted away from people sitting or standing around fire pit 10. The drafting of air and smoke through holes 28 starts slowly when the fire is first lit and the tube 22 is cold, but increases rapidly as the tube 22 heats up. FIG. 6 shows how flame F also drafts into draft level openings 28 shortly after the fire gets going. The tube 22 can get very hot in a short time, especially if made from heat-conductive metal, and almost immediately after the fire is lit, the smoke from the campfire begins exhausting from the open upper end of the tube as shown in FIGS. 1 and 4. This leaves the spectators relatively unmolested by smoke from start to finish of the campfire, even when the campfire dies down to smoldering embers or coals. We have also found that little or no debris (sparks, embers, etc.) from the fire drawn through holes 28 is exhausted from the upper end 26 of the smokestack, just smoke. Additionally, combustibles can be dropped into the open upper end of the tube once the campfire and tube are hot, creating shooting flames E from the top as illustrated in FIG. 5; at night this afterburner effect is quite spectacular.

Other advantageous side effects include an increase in the speed at which the fire is initially kindled; improved efficiency in the fire's burn due to the radial draft maintained directly through the fire 40 via holes 28 in lower draft level region 30*a*; and an increase in radiant heating of bystanders once tube 22 heats up. Even wet wood can be kept burning using smokestack 22, with smoke experienced by people around the fire limited or reduced. Smokestack 20 also provides (where permitted) a convenient place to efficiently burn trash that can optionally be thrown into the open upper end of the tube.

Smokestack 20 remains a part of the campfire 40 from start to finish, improving the fire's efficiency from the moment of lighting onward, adding to the visual appeal of the fire, increasing heat output, and reducing the irritation of smoke to people seated or standing around the fire.

When it is desired to remove smokestack 20 from fire pit 10, preferably when the fire is out, one or more sticks or tools can be inserted into or through the aligned upper "pull" holes 29 on the upper end of tube 22 to safely lift the tube out of the fire pit, even if the tube is still hot. The upper end 26 of tube 22 tends to remain relatively free of soot due to the high temperature of combustion at the top of the tube, making it easier to keep clean while removing the tube from the fire pit.

Pull holes 29 are optional and can be omitted, however, and the hot pipe can be removed with insulated gloves, as well, or by inserting a tool or poker or stick into one or more of the regular draft openings 28.

Although unnecessary, the open upper end 26 of tube 22 can be provided with a spark arrestor, if local park or campground authorities require it or if it is deemed advisable. The use of spark arrestors or other partial obstructions or reinforcing structures across the upper or lower ends of tube 22 should be considered within the definition of "open", meaning sufficient to permit the passage of smoke and air from the upper end 26 in a manner that still provides an effective air- and smoke-drawing draft through sidewall draft openings 28; and, for tubes 22 whose lower ends are intended to be buried for anchoring, sufficient to permit the entry of earth/ash/gravel/sand etc. at the lower end 24 to help anchor tube 22 when buried in the fire pit.

Figure 7:
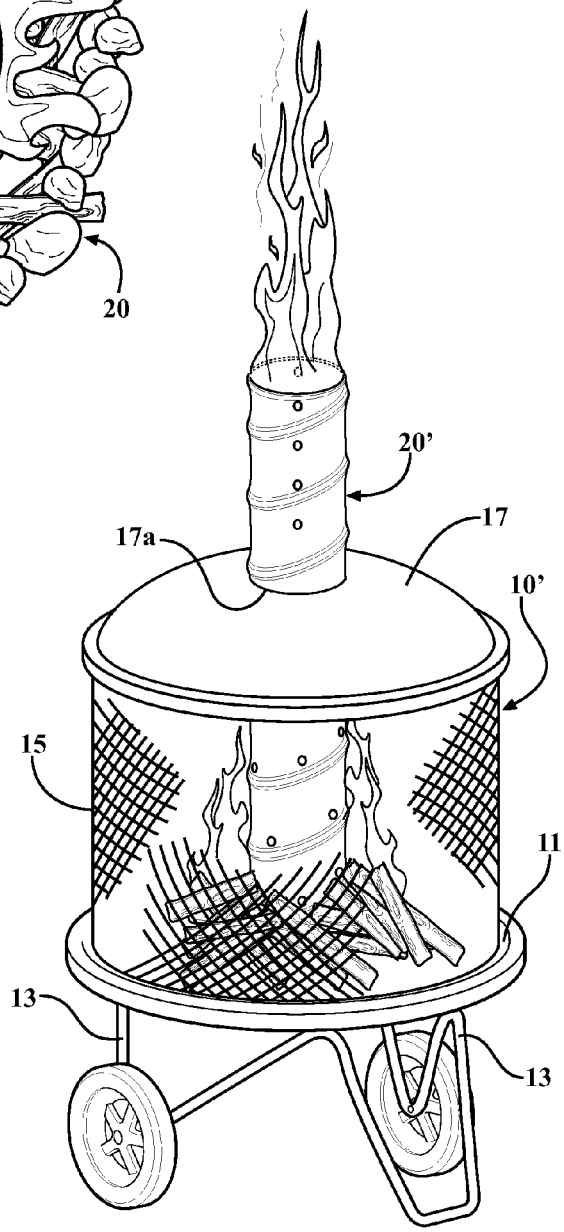
FIG. 7 is a perspective view of a smaller embodiment of the campfire smokestack of FIGS. 1-6, used in a manmade fire pit.

FIG. 7 shows a modified campfire smokestack 20', similar to smokestack 20 in FIGS. 1-6 except that it is smaller and its lower end is adapted to be anchored or secure on the metal fire pan 11 of a manmade fire pit 10' of a known and commercially available type, typically made from metal and/or ceramic. Fire pits such as 10' are commonly used on decks and patios, with legs 13 supporting the fire pan 11 off the ground at a height sufficient to protect the deck surface from heat, and to place the campfire at a convenient height to be felt and enjoyed by people sitting in chairs or on benches near the fire pit. Such manmade fire pits often have a 360-degree mesh guard such as 15 that surrounds the fire without significantly obscuring the view or blocking the radiant heat from people seated around the fire, allowing the fire to be enjoyed as the equivalent of a traditional ground-based campfire. Mesh guard often supports a removable metal cover 17, which may have an opening 17*a* for smokestack 20'. The lower end of smokestack 20' can be anchored in any manner to the fire pit 10', for example permanently by welding; or removably, for example with screw-fastened tabs or flanges, with a weighted lower end, or with a collar in the fire pan sized to accept the lower end of the smokestack.

It will finally be understood that the disclosed embodiments are representative of presently preferred examples of how to make and use the claimed invention, but are intended to be explanatory rather than limiting of the scope of the invention as defined by the claims below. Reasonable variations and modifications of the illustrated examples in the foregoing written specification and drawings are possible without departing from the scope of the invention as defined in the claims below. It should further be understood that to the extent the term "invention" is used in the written specification, it is not to be construed as a limiting term as to number of claimed or disclosed inventions or the scope of any such invention, but as a term which has long been conveniently and widely used to describe new and useful improvements in technology. The scope of the invention is accordingly defined by the following claims.

What is claimed is:

1. A method for burning a campfire, comprising:

anchoring a lower end of a non-combustible tube upright in a fire pit, the tube comprising a sidewall and an interior campfire-free draft zone in the lower end corresponding to a campfire height, such that an open upper end of the tube is at a height above a campfire height and a plurality of lower draft openings formed through the sidewall adjacent the lower end are ranged vertically at a campfire height, and the method further comprising building a campfire at campfire height around the exterior of the lower end of the tube over at least some of the draft openings while leaving the interior draft zone essentially free of combustible campfire materials, and maintaining the tube in the campfire for a duration of the campfire.

2. The method of claim 1, wherein the tube is anchored in the fire pit by burying a portion of the lower end below the campfire.

3. The method of claim 1, wherein the lower end of the tube is anchored in the fire pit at ground level.

4. The method of claim 1, wherein the campfire is maintained around the lower end of the tube over the at least some of the draft openings for substantially the duration of the campfire.

5. The method of claim 1, further comprising anchoring the non-combustible tube in a manmade fire pit.

6. In combination with a fire pit, an apparatus for improving the burning qualities of a campfire in the fire pit, comprising:

a non-combustible tube comprising a sidewall, a lower end anchored in the fire pit, an open upper end higher than a campfire height, and a plurality of draft openings formed through the sidewall adjacent the lower end and ranged vertically to define a draft region at a campfire height, the combination further comprising a campfire in the fire pit at campfire height around the exterior of the lower end of the tube over at least some of the draft openings, and further wherein the campfire is not inside the tube.

7. The combination of claim 6, wherein the fire pit comprises a manmade fire pit.

8. The combination of claim 6, wherein the tube further comprises upper draft openings in an upper portion of the sidewall above the campfire height.

9. The combination of claim 6, wherein the tube further comprises an unobstructed interior campfire-free draft zone in the lower end corresponding to the campfire height draft region and enclosed by the sidewall except for the lower draft openings.

10. A method for burning a campfire, comprising:

building a campfire at campfire height around an exterior of a lower end of a non-combustible tube whose lower end is anchored upright in a fire pit, the tube comprising a sidewall and an interior campfire-free draft zone in the lower end corresponding to a campfire height, such that an open upper end of the tube is at a height above a campfire height, and a plurality of lower draft openings formed through the sidewall adjacent the lower end are ranged vertically at a campfire height, the campfire being built over at least some of the draft openings while leaving the interior draft zone essentially free of combustible campfire materials, and maintaining the tube in the campfire for a duration of the campfire.

* * * * *